US006827462B2

(12) United States Patent
Wangenheim et al.

(10) Patent No.: US 6,827,462 B2
(45) Date of Patent: Dec. 7, 2004

(54) CHARGER WITH NIGHT LIGHT FOR PORTABLE ELECTRICAL DEVICES

(75) Inventors: Duane Wangenheim, Chatsworth, CA (US); David Nazar, Los Angeles, CA (US)

(73) Assignee: Hypercel Corp., Valencia, CA (US)

( * ) Notice: Subject to any disclaimer, the term of this patent is extended or adjusted under 35 U.S.C. 154(b) by 0 days.

(21) Appl. No.: 10/322,297

(22) Filed: Dec. 18, 2002

(65) Prior Publication Data

US 2003/0199183 A1 Oct. 23, 2003

Related U.S. Application Data

(60) Provisional application No. 60/341,217, filed on Dec. 20, 2001.

(51) Int. Cl.[7] ..... F21V 9/16

(52) U.S. Cl. ..... 362/84; 362/226; 362/253; 320/115

(58) Field of Search ..... 362/84, 95, 183, 362/226, 253; 320/111, 115, DIG. 19

(56) References Cited

U.S. PATENT DOCUMENTS 5,548,494 A * 8/1996 Blackman ..... 362/183
5,587,645 A * 12/1996 Sciammarella et al. ..... 362/253
5,662,408 A * 9/1997 Marischen ..... 362/226
6,034,505 A * 3/2000 Arthur et al. ..... 320/115
6,250,773 B1 * 6/2001 Lai ..... 362/226

* cited by examiner

*Primary Examiner*—Stephen F Husar
(74) *Attorney, Agent, or Firm*—Andrew B. Katz, Esq.; Fox Rothschild LLP

(57) ABSTRACT

An assembly and apparatus having a night light and adapted to provide electrical power to a portable electrical device. In one aspect, the invention is an apparatus for connecting a portable electrical device to a power source through an electrical outlet, the apparatus comprising: a housing compartment having an electroluminescent cell disposed on said housing compartment; a circuit within said housing compartment, said electroluminescent cell electrically connected to said circuit; means for electrically connecting said circuit to said electrical outlet; and means for electrically connecting said circuit to a port of said portable electrical device. Alternatively, the apparatus comprises a lamp instead of an electrolumiscent cell and the means for electrically connecting said circuit to said electrical outlet is a power cord. In yet another aspect, the invention is an assembly comprising said apparatus above and said portable electrical device.

23 Claims, 6 Drawing Sheets

CHARGER WITH NIGHT LIGHT FOR PORTABLE ELECTRICAL DEVICES

CROSS-REFERENCE TO RELATED APPLICATIONS

This application claims the benefit of Provisional Application No. 60/341,217 filed Dec. 20 2001.

TITLE OF THE INVENTION

The title of this invention is "CHARGER WITH NIGHT LIGHT FOR PORTABLE ELECTRICAL DEVICES"

BACKGROUND OF THE INVENTION

This invention relates generally to the field of portable electrical devices, and specifically to apparati that electrically connect portable electrical devices to a power source.

Due to recent advancements in technology, electrical devices such as phones, computers, radios, televisions, and other low voltage electrical devices have become completely portable. These electrical devices can receive their electrical power either from an internal electrical source such as a battery or from a direct electrical connection to an electrical outlet. These portable devices are often taken on long distance and out-of-town overnight trips. Thus, in taking one of these portable devices on an extended trip, the traveler often must be sure to bring a charger for the internal battery. Often, these chargers also act as adapters in that they provide a connection from the portable device to an electrical outlet.

Moreover, many travelers that use these portable devices often stay in hotel rooms or other places of lodging where the surroundings are unfamiliar. As a result, a night-light is often desired to allow for some visibility in the room when it is dark. While the light emitted from the night-light should not be so bright as to disturb the rest of the traveler, it should provide enough light to the surroundings so that the traveler does not bump into or trip over furniture and other objects.

In order to save packing space and reduce carrying weight, there is a need to have a single apparatus that can: (1) act as a night-light; (2) provide a connection to a power source for a portable electrical device during its operation; and (3) charge the internal batteries of the portable electrical device so that the electrical device can operate when access to an electrical outlet is unavailable.

Currently, there are no existing apparatus that can perform all of these functions satisfactorily. For example, U.S. Pat. No. 5,587,645, Sciammarella, discloses a night-light incorporated into a charger-base for a cordless phone. The Sciammarella night-light is limited to charging a cordless phone. Thus, the Sciammarella night-light can not be taken on long trips or out-of-town stays without rendering the electrical device it is intended to charge inoperable (i.e. the cordless phone). As a result, those travelers wishing to have both a night-light and a charger for their portable phone during out-of-town trips still have to bring both a charger for the phone and a night-light. Thus, a truly portable night-light capable of charging portable phones (i.e. cellular phones) is not currently available. A similar need exists with respect to other truly portable electrical devices, such as lap top computers, radios, televisions, etc.

Another limitation of existing prior art devices, such as Sciammarella, is that theses night light devices are incapable of allowing operation of the electrical device they charge while simultaneously charging the internal battery of the electrical device or while providing a direct connection for the electrical device to a power source.

Yet, another limitation of available apparatus that act as night lights chargers is that the lights are often too bright, disturbing the sleep of the user and consuming unnecessary amounts of electricity.

Still another limitation of prior art night light chargers are that the housing compartments which contain the light bulbs are plugged directly into an electrical outlet. This essentially restricts the position of the night light at or near the outlet. As a result, the night light illuminates only that area directly near the outlet. Often, this may not be the area of the room for which lighting is needed. Moreover, if the electrical device being charged is placed in an area not directly near the outlet, the electrical device can be stepped on or otherwise inadvertently damaged in the dark.

SUMMARY OF THE INVENTION

An object of the present invention is to provide an apparatus capable of acting as a night light, an electrical charger, and a connection to an electrical power source that is portable and capable of charging and powering an operable portable device.

Another object of the present invention is to provide an apparatus that acts as a night light, an electrical charger, and a connection to an electrical power source whose illumination does not disturb the sleep of its user.

Still another object of the present invention is to provide a device that acts as a night-light, an electrical charger, and a connection to an electrical power source that minimizes the use of electricity required to sufficiently illuminate a desired area.

Yet another object of the present invention is to provide a device that acts as a night-light, an electrical charger, and a connection for an electrical power source that does not restrict the position of the night light to the outlet area of the wall.

These and other objects are met by the present invention which in one aspect is an apparatus for connecting a portable electrical device to a power source through an electrical outlet, the apparatus comprising: a housing compartment having an electroluminescent cell disposed on said housing compartment; a circuit within said housing compartment, said electroluminescent cell electrically connected to said circuit; means for electrically connecting said circuit to said electrical outlet; and means for electrically connecting said circuit to a port of said portable electrical device.

Preferably, the apparatus further comprises a lamp switch on said housing compartment and electrically connected to said circuit in series with said electrolumiscent cell. In this embodiment, it is further preferable that said electrolumiscent cell and said lamp switch be electrically connected to said circuit in parallel with said means for electrically connecting said circuit to said port of said portable electrical device. The electrolumiscent cell preferably has a wattage of 0.03 to 0.05 watts.

In one embodiment, the means for electrically connecting said circuit to said electrical outlet can be a set of prongs, said prongs protruding from said housing compartment. These prongs can be pivotally connected to said housing compartment.

Alternatively, the means for electrically connecting said circuit to said electrical outlet can be a power cord having a first end and a second end, said first end having a set of prongs and said second end adapted to electrically connect to said circuit.

The apparatus can be used in conjunction with portable electrical devices such as a laptop computer, a cellular telephone, a radio, or a television.

Preferably, the means for electrically connecting said circuit to said port of said portable electrical device is a port cord and a jack, said jack adapted to electrically connect to said port of said portable electrical device, wherein said port is a power supply port.

In another aspect, the invention is an apparatus for connecting a portable electrical device to a power source through an electrical outlet, the apparatus comprising: a housing compartment having a lamp disposed on said housing compartment; a circuit within said housing compartment, said lamp electrically connected to said circuit; a power cord having a first end and a second end, said first end having a set of prongs and adapted to electrically connect to said electrical outlet, said second end adapted to electrically connect to said circuit; and means for electrically connecting said circuit to a port of said portable electrical device.

Preferably, the lamp is an electrolumiscent cell having a wattage of 0.03 to 0.05 watts. The apparatus can further comprise a lamp switch on said housing compartment and electrically connected to said circuit in series with said lamp. In this embodiment, it is preferable that the lamp and the lamp switch be electrically connected to said circuit in parallel with said means for electrically connecting said circuit to said port of said portable electrical device.

Also preferably, the means for electrically connecting said circuit to said port of said portable electrical device is a port cord and a jack, said jack adapted to electrically connect to said port of said portable electrical device, wherein said port is a power supply port.

The apparatus can be used in conjunction with portable electrical devices such as a laptop computer, a cellular telephone, a radio, or a television.

In yet another aspect, the invention is a portable electrical device assembly comprising: a portable electrical device having a power supply port; and an apparatus for connecting said portable electrical device to a power source through an electrical outlet, the apparatus comprising: a housing compartment having a lamp disposed on said housing compartment; a circuit within said housing compartment, said lamp electrically connected to said circuit; means for electrically connecting said circuit to said electrical outlet; and means for electrically connecting said circuit to said power supply port of said portable electrical device.

The lamp can be an electrolumiscent cell preferably having a wattage of 0.03 to 0.05 watts. Preferably, the apparatus of the assembly further comprises a lamp switch on said housing compartment and electrically connected to said circuit in series with said electrolumiscent cell. Also preferably, said lamp and said lamp switch will be electrically connected to said circuit in parallel with said means for electrically connecting said circuit to said power supply port of said portable electrical device.

The means for electrically connecting said circuit to said electrical outlet can be a set of prongs protruding from said housing compartment and pivotally connect to said housing compartment. Alternatively, the means for electrically connecting said circuit to said electrical outlet comprises a power cord having a first end and a second end, said first end comprising a set of prongs adapted to electrically connect to said electrical outlet, said second end adapted to electrically connect to said circuit.

The portable electrical device can be a laptop computer, a cellular telephone, a radio, or a television.

Preferably, the means for electrically connecting said circuit to said power supply port of said portable electrical device comprises a port cord and a jack, said jack adapted to electrically connect to said power supply port of said portable electrical device.

DETAILED DESCRIPTION OF THE DRAWINGS

Figure 1:
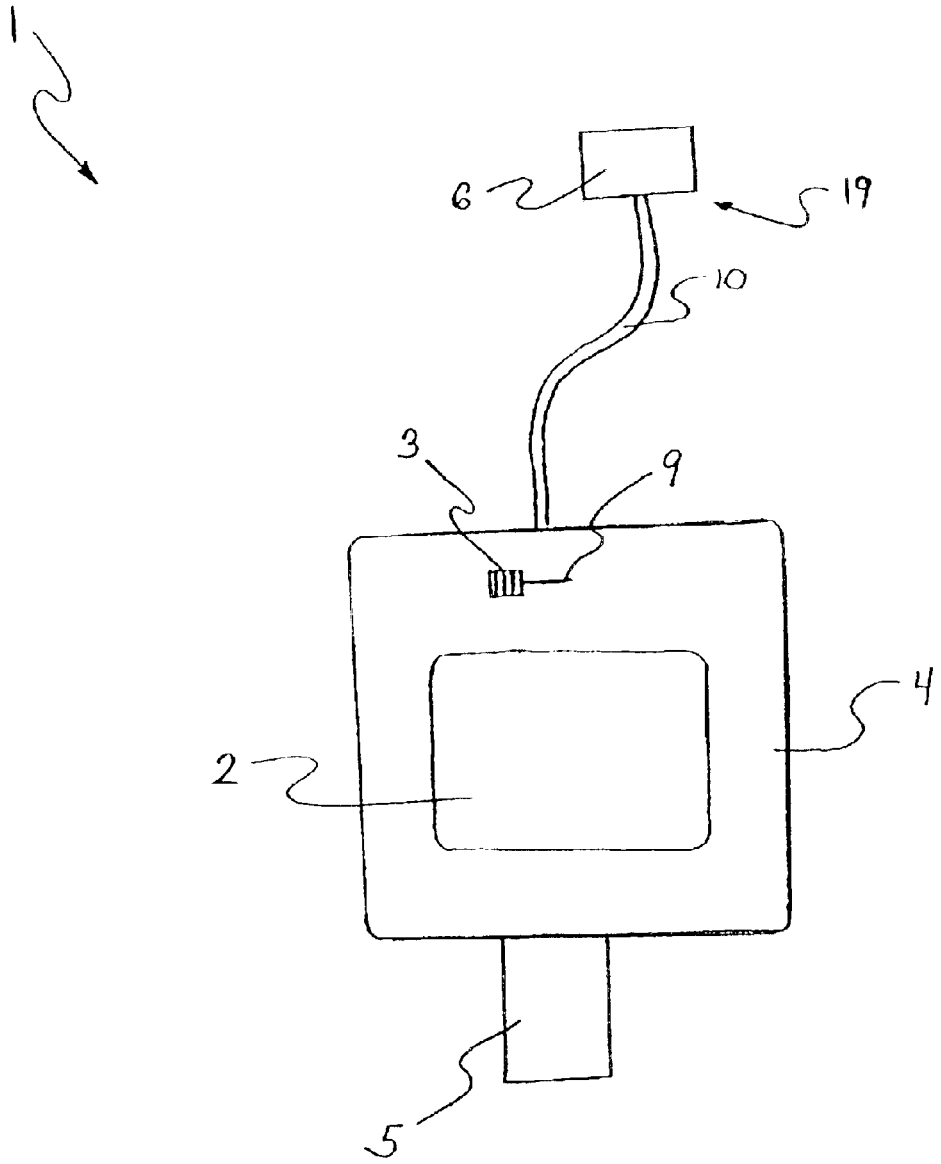
FIG. 1 is front schematic view of an embodiment of the present invention, a night light charger, wherein the power supply connection and the portable electrical device connection are generically illustrated.

FIG. 1 illustrates an embodiment of the present invention, night light charger 1. Night light charger 1 comprises housing compartment 4, power supply connection 5, and portable electrical device connection 19. Portable electrical device connection 19 comprises port cord 10 and jack 6 (illustrated as a generic box). Housing compartment 4 comprises lamp 2 (illustrated as an electroluminescent cell), lamp switch 3, and switch slot 9. Housing compartment 4 houses an internal circuit board (not illustrated) which contains the appropriate aspects of the illustrated circuit of FIG. 2. Power supply connection 5, portable electrical device connection 19, lamp 2, and lamp switch 3 are electrically connected to the internal circuit board. Jack 6 is electrically connected to port cord 10 which in turn is electrically coupled to the internal circuit board.

Figure 2:
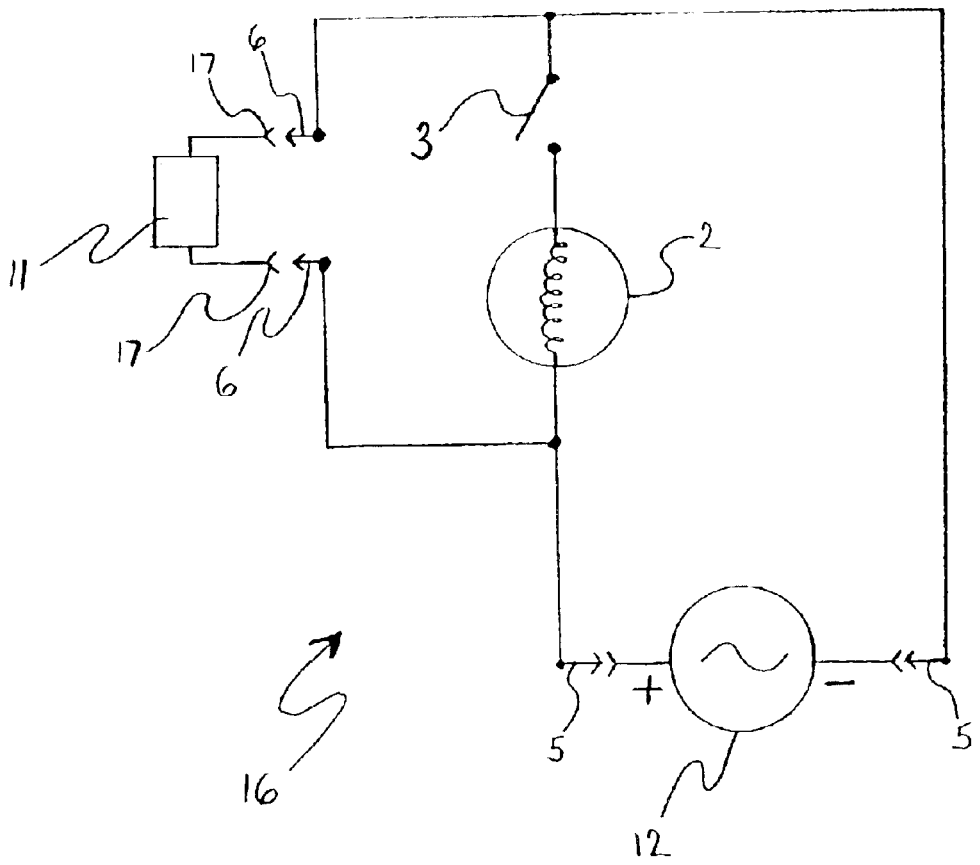
FIG. 2 is a schematic of the circuit of the night light charger of FIG. 1 being connected to a portable electrical device and a power source.
Figure 3:
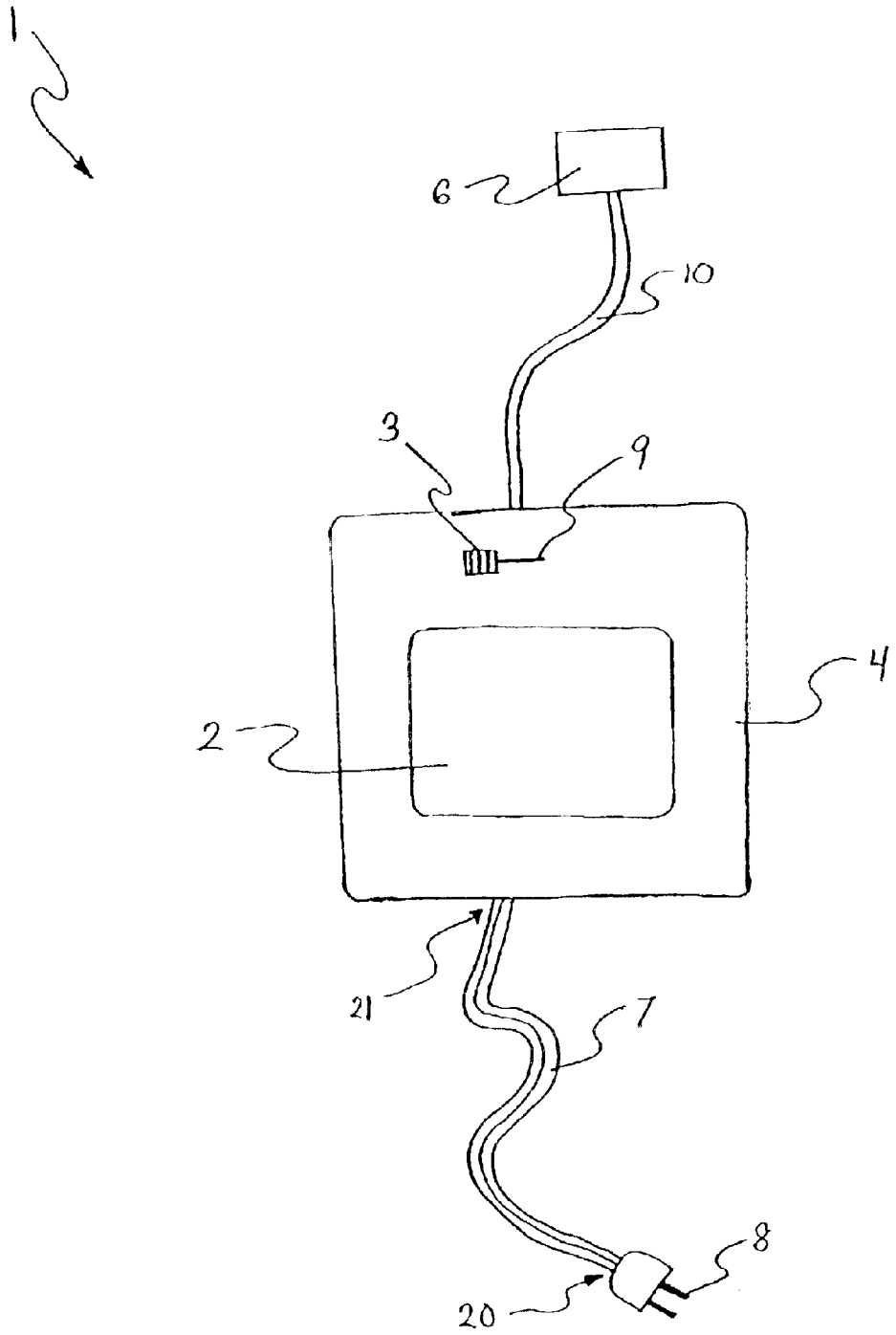
FIG. 3 is a front schematic view of the night light charger of FIG. 1 wherein the power supply connection is a power cord with prongs.

Referring to FIG. 3, an embodiment of night charger 1 is shown wherein power supply connection 5 (FIG. 1) is a power cord 7 having first end 20 and second end 21. Power cord 7 is a standard electrical wire that is capable of carrying an electric current, such as plastic coated copper. First end 20 comprises a set of prongs 8 electrically attached to first end 20 of the power cord 7. Prongs 8 are adapted to be capable of being inserted into an electrical outlet, thus providing an electrical connection to a source of electrical energy. Second end 21 of power cord 7 electrically connects to the internal circuit board (not illustrated) within housing compartment 4, thus providing electricity to circuit 16 illustrated in FIG. 2. Implementing power cord 7 allows the user to place housing compartment 4, which contains lamp 2, in whatever location or position the user desires. Power cord 7 can be any desired length. This gives the user greater flexibility in achieving optimal placement of the night light portion of the invention.

Figure 4:
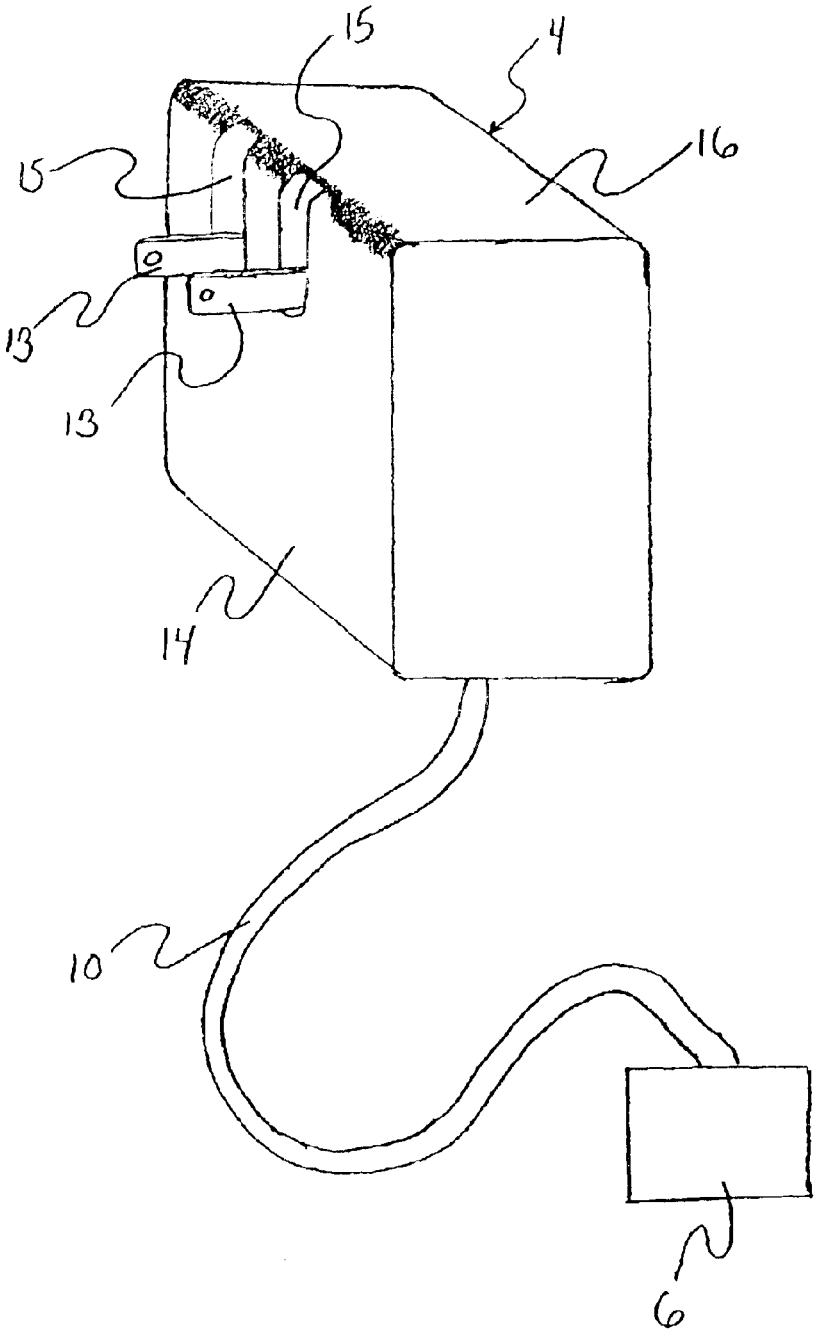
FIG. 4 is a perspective elevational view of the night light charger of FIG. 1 wherein the power supply connection is a set of prongs pivotally connected to a housing compartment.

Referring now to FIG. 4, in another embodiment of the invention, power supply connection 5 (FIG. 1) is a set of prongs 13 protruding directly from the rear surface 14 of housing compartment 4. Prongs 13 are adapted to be capable of being slidably inserted into an electrical outlet. Prongs 13 are pivotally connected to the housing compartment 4 to allow the housing prongs 13 to be rotated to a retracted position (not illustrated). When in the retracted position prongs 13 are fully within prong grooves 15 which are located on the rear surface 14 of housing compartment 4. While in the retracted position, the prongs 13 are flush with both rear surface 14 and top surface 16 of housing compartment 4. Prongs 13 are electrically connected to the internal circuit board so that when prongs 13 are inserted into an electrical outlet, electricity is supplied to the circuit illustrated in FIG. 2.

Figure 5:
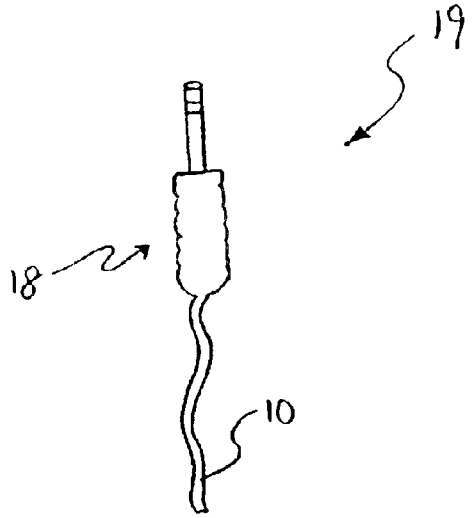
FIG. 5 is a front view of a first jack embodiment that can act as a portable electrical device connection.
Figure 6:
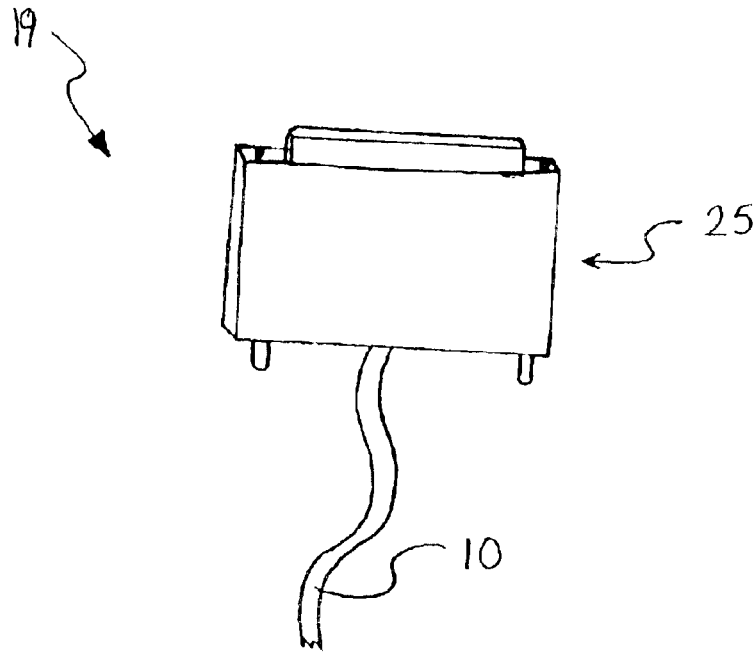
FIG. 6 is a front view of a second jack embodiment that can act as a portable electrical device connection.

Referring to FIGS. 5 and 6, portable electrical device connection 19 (FIG. 1) is illustrated with different embodiments of jack 6 (FIG. 1). Each embodiment of portable electrical device connection 19 still comprises port cord 10 and jack 6. In FIG. 5, jack 6 is illustrated as male connection 18. In FIG. 6, jack 6 is illustrated as multi-pin connection 25, similar to those used with computer data ports. While jack 6 is illustrated as either a male connection 18 or multi-pin connection 25, jack 6 can be any type of male or female plug, adapter, or connector that can form an electrical connection.

FIG. 2 schematically illustrates one embodiment of a circuit 16 suitable to practice the present invention. Discussion of FIG. 2 will be had in reference to the elements of FIG. 1. Power supply connection 5 is electrically connected to a source of power 12, such as an electrical outlet. As such, circuit 16 can receive an electrical current from power source 12. Portable electrical connection 19 can be electrically connected to power supply port 17 of a portable electrical device 11 via jack 6. When jack 6 is properly coupled to power supply port 17 of a portable electrical device 11, portable device 11 is electrically connected to the circuit 16.

When both portable electrical device 11 and power supply 12 are electrically connected to circuit 16 as discussed above, a closed circuit is formed and portable electrical device 11 receives an electrical current. This electrical current can be used to power portable electrical device 11 for use or can be used to charge an internal battery (not illustrated) of portable electrical device 11.

Circuit 16 also comprises lamp 2 which is electrically connected in parallel to portable electrical device 11. The flow of electric current through lamp 2 is controlled by lamp switch 3. Lamp switch 3 can be slidably alternated between an "on" and "off" position by sliding lamp switch 3 along switch slot 9 (FIG. 1). If the lamp switch 3 is in the "off" position, the parallel circuit on which lamp 2 is located is open. As a result, electricity can not flow through lamp 2 and lamp 2 will not be illuminated. If lamp switch 3 is in the "on" position, the parallel circuit on which lamp 2 is located is closed, allowing electricity to flow through lamp 2, thus illuminating lamp 2.

Because the circuits are in parallel, lamp 2 can receive power from the power source 12 even if the means for connecting to a port of a portable electrical device 6 is not connected to a device 11, so long as lamp switch 3 is in the "on" (i.e. closed) position. Likewise, portable electrical device 11 can receive power even if lamp switch 3 is in the "off" (i.e. open) position.

As shown in the FIGS. 1 and 3, the preferred embodiment of lamp 2 is an electrolumiscent cell. The wattage of the electroluminscent cell should be chosen so that a level of illumination is provided that is sufficient to light a desired area without being so bright as to disturb the sleep of a user in the same area. Also, the wattage of the electrolumiscent cell should not be so high so as to use unnecessary amounts of electricity. Preferably, the wattage of the electrolumiscent cell is in the range of 0.03 to 0.05 watts, but can be encompass a greater range without losing the aforementioned advantages.

While the invention has been described and illustrated in detail, various alternatives and modifications will become readily apparent to those skilled in the art without departing from the spirit and scope of the invention.

What is claimed is:

1. An apparatus for connecting a portable electrical device to a power source through an electrical outlet, the apparatus comprising:

a housing compartment having an electroluminescent cell disposed on said housing compartment;

a circuit within said housing compartment, said electroluminescent cell electrically connected to said circuit;

means for electrically connecting said circuit to said electrical outlet; and means for electrically connecting said circuit to a port of said portable electrical device, wherein said means for electrically connecting said circuit to said port of said portable electrical device comprises a port cord and a jack, said jack adapted to electrically connect to said port of said portable electrical device, wherein said port is comprises a power supply port.

2. The apparatus of claim 1 further comprising a lamp switch on said housing compartment and electrically connected to said circuit in series with said electroluminescent cell.

3. The apparatus of claim 2 wherein said electroluminescent cell and said lamp switch are electrically connected to said circuit in parallel with said means for electrically connecting said circuit to said port of said portable electrical device.

4. The apparatus of claim 1 wherein said electroluminescent cell has a wattage of 0.03 to 0.05 watts.

5. The apparatus of claim 1 wherein said means for electrically connecting said circuit to said electrical outlet comprises a set of prongs, said prongs protruding from said housing compartment.

6. The apparatus of claim 5 wherein said housing prongs are pivotally connected to said housing compartment.

7. The apparatus of claim 1 wherein said means for electrically connecting said circuit to said electrical outlet comprises a power cord having a first end and a second end, said first end having a set of prongs and said second end adapted to electrically connect to said circuit.

8. The apparatus of claim 1 herein said portable electrical device is selected from the group consisting of a laptop computer, a cellular telephone, a radio, and a television.

9. An apparatus for connecting a portable electrical device to a power source through an electrical outlet, the apparatus comprising:

a housing compartment having a lame disposed on said housing compartment;

a circuit within said housing compartment, said lamp electrically connected to said circuit;

a power cord having a first end and a second end, said first end having a set of prongs and adapted to electrically connect to said electrical outline, said second end adapted to electrically connect to said circuit; and means for electrically connecting said circuit to a port of said portable electrical device, wherein said means for electrically connecting said circuit to said port of said portable electrical device comprises a port cord and a jack, said jack adapted to electrically connect to said port of said portable electrical device, wherein said port is comprises a power supply port.

10. The apparatus of claim 9 wherein said lamp comprises an electroluminescent cell.

11. The apparatus of claim 10 wherein said electroluminescent cell has a wattage of 0.03 to 0.05 watts.

12. The apparatus of claim 9 further comprising a lamp switch on said housing compartment and electrically connected to said circuit in series with said lamp.

13. The apparatus of claim 12 wherein said lamp and said lamp switch are electrically connected to said circuit in parallel with said means for electrically connecting said circuit to said port of said portable electrical device.

14. The apparatus of claim 9 wherein said portable electrical device is selected from the group consisted of a laptop computer, a cellular telephone, a radio, and a television.

15. A portable electrical device assembly comprising:

a portable electrical device having a power supply; and an apparatus for connecting said portable electrical device to a power source through an electrical outlet, the apparatus comprising: a housing compartment having a lamp disposed on said housing compartment; a circuit within said housing department, said lamp electrically connected to said circuit; means for electrically connecting said circuit to said electrical outlet; and means for electrically connecting said circuit to said power supply port of said portable electrical device, wherein said means for electrically connecting said circuit to said power supply port of said portable electrical device comprises a port cord and a jack, said jack adapted to electrically connect to said power supply port of said portable electrical device.

16. The assembly of claim 15 wherein said lamp comprises an electroluminescent cell.

17. The assembly of claim 16 wherein said electroluminescent cell has a wattage of 0.03 to 0.05 watts.

18. The assembly of claim 15 further comprising a lamp switch on said housing compartment and electrically connected to said circuit in series with said electroluminescent cell.

19. The assembly of claim 18 wherein said lamp and said lamp switch are electrically connected to said circuit in parallel with said means for electrically connecting said circuit to said port of said portable electrical device.

20. The assembly of claim 15 wherein said means for electrically connecting said circuit to said electrical outlet comprises a set of prongs, said prongs protruding from said housing compartment.

21. The assembly of claim 15 wherein said housing prongs are pivotally connected to said housing compartment.

22. The assembly of claim 15 wherein said means for electrically connecting said circuit to said electrical outlet comprises a power cord having a first end and a second end, said first end comprising a set of prongs adapted to electrically connect to said electrical outlet, said second end adapted to electrically connect to said circuit.

23. The assembly of claim 15 wherein said portable electrical device is selected from the group consisting of a laptop computer, a cellular telephone, a radio and a television.

* * * * *